US007870737B2

(12) United States Patent
Snyder

(10) Patent No.: US 7,870,737 B2
(45) Date of Patent: Jan. 18, 2011

(54) HOODED AIR/FUEL SWIRLER FOR A GAS TURBINE ENGINE

(75) Inventor: Timothy S. Snyder, Glastonbury, CT (US)

(73) Assignee: United Technologies Corporation, Hartford, CT (US)

( * ) Notice: Subject to any disclaimer, the term of this patent is extended or adjusted under 35 U.S.C. 154(b) by 957 days.

(21) Appl. No.: 11/696,766

(22) Filed: Apr. 5, 2007

(65) Prior Publication Data

US 2008/0245075 A1 Oct. 9, 2008

(51) Int. Cl.
*F02C 1/00* (2006.01)
*F02G 3/00* (2006.01)

(52) U.S. Cl. ..... 60/748; 239/399; 60/737

(58) Field of Classification Search ..... 60/737, 60/748; 239/399
See application file for complete search history.

(56) References Cited

U.S. PATENT DOCUMENTS

| | | | | | |
|---|---|---|---|---|---|
| 3,605,405 | A * | 9/1971 | Du Bell | ..... | 60/737 |
| 3,648,457 | A * | 3/1972 | Bobo | ..... | 60/737 |
| 3,808,803 | A * | 5/1974 | Salvi | ..... | 60/737 |
| 3,946,552 | A * | 3/1976 | Weinstein et al. | ..... | 60/743 |
| 4,023,351 | A * | 5/1977 | Beyler et al. | ..... | 60/742 |
| 6,212,870 | B1 * | 4/2001 | Thompson et al. | ..... | 60/772 |
| 6,799,427 | B2 * | 10/2004 | Calvez et al. | ..... | 60/737 |
| 7,089,741 | B2 * | 8/2006 | Ikeda et al. | ..... | 60/725 |
| 7,464,553 | B2 * | 12/2008 | Hsieh et al. | ..... | 60/748 |
| 7,565,803 | B2 * | 7/2009 | Li et al. | ..... | 60/748 |
| 7,581,396 | B2 * | 9/2009 | Hsieh et al. | ..... | 60/748 |
| 7,628,019 | B2 * | 12/2009 | Tanner et al. | ..... | 60/748 |
| 7,654,000 | B2 * | 2/2010 | Prociw et al. | ..... | 29/890.142 |
| 2007/0028618 | A1 * | 2/2007 | Hsiao et al. | ..... | 60/737 |
| 2008/0229753 | A1 * | 9/2008 | Li et al. | ..... | 60/748 |
| 2009/0038312 | A1 * | 2/2009 | Hernandez et al. | ..... | 60/748 |

* cited by examiner

*Primary Examiner*—William H Rodriguez
(74) *Attorney, Agent, or Firm*—Carlson, Gaskey & Olds, P.C.

(57) ABSTRACT

A gas turbine engine pilot assembly includes a swirler having high and low pressure sides. A hood at least partially encloses the swirler on the high pressure side. The hood is secured over the swirler, in one example. The hood includes an aperture creating a tortuous path from the high pressure side to the low pressure side through the swirler. The hood reduces the differential pressure across the swirler by reducing the velocity and pressure of the air before entering the swirler. In one example, the hood includes first and second spaced apart walls interconnected by a perimeter wall. The walls form a generally annular structure, in one example. At least one of the walls includes an array of apertures communicating with a cavity interiorly arranged within the walls upstream from the swirler. Air from the high pressure side flows through the apertures and is slowed before passing through the swirler and into a combustion chamber.

12 Claims, 1 Drawing Sheet

HOODED AIR/FUEL SWIRLER FOR A GAS TURBINE ENGINE

This invention was made with government support with the United States Navy under Contract No.: N00019-02-C-3003. The government therefore has certain rights in this invention.

BACKGROUND OF THE INVENTION

This application relates to a gas turbine engine. More particularly, the application relates to an air/fuel swirler that induces mixing between the air and fuel prior to ignition.

Gas turbine engines typically include a swirler having vanes that induces a desired air/fuel flow prior to ignition. The air/fuel mixture must light on-the-fly under various operating conditions. It is desirable to light the mixture on-the-fly under conditions in which there are high pressure drops across the swirler. At high differential pressures, the velocity is much higher than desired making it difficult to light the mixture. The mixture downstream from the swirler within the combustion chamber is typically under a low pressure. The air entering the swirler can be under very high pressures under some conditions, creating high velocities in the combustion chamber, which are adverse to lighting.

What is needed is a gas turbine engine capable of lighting on-the-fly under a greater variety of operating conditions, in particular, during conditions that typically have had high differential pressures across the swirler.

SUMMARY OF THE INVENTION

A gas turbine engine pilot assembly includes a swirler having high and low pressure sides. A hood at least partially encloses the swirler on the high pressure side. The hood is secured over the swirler, in one example. The hood includes an aperture creating a tortuous path from the high pressure side to the low pressure side through the swirler. The hood reduces the differential pressure across the swirler by reducing the velocity and pressure of the air before entering the swirler.

In one example, the hood includes first and second spaced apart walls interconnected by a perimeter wall. The walls form a generally annular structure, in one example. At least one of the walls includes an array of apertures communicating with a cavity interiorly arranged within the walls upstream from the swirler. Air from the high pressure side flows through the apertures and is slowed before passing through the swirler and into a combustion chamber.

These and other features of the present invention can be best understood from the following specification and drawings, the following of which is a brief description.

DETAILED DESCRIPTION OF THE PREFERRED EMBODIMENT

Figure 1:
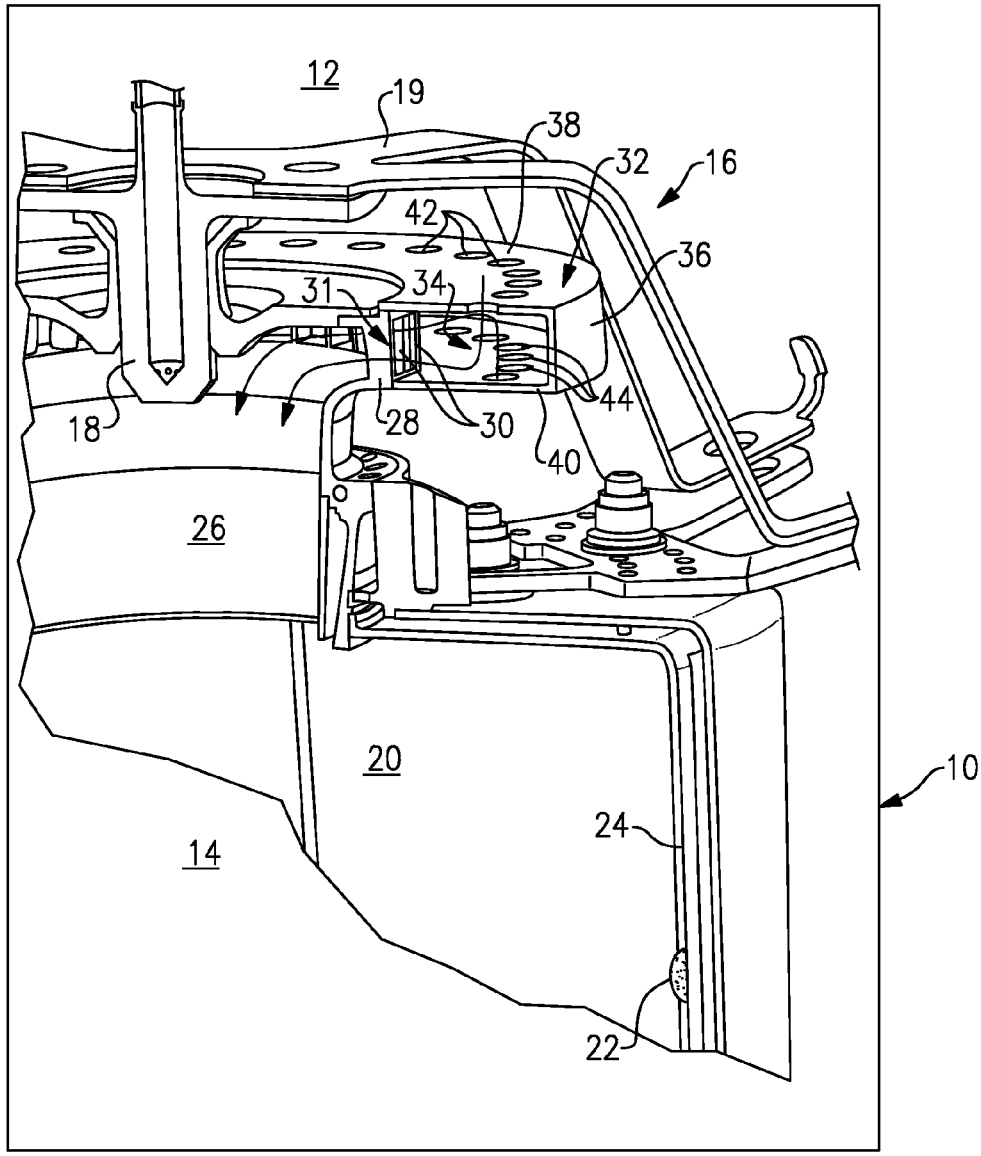
FIG. 1 is a partially broken schematic view of an augmentor pilot.

A gas turbine engine 10 is shown in a highly schematic fashion in FIG. 1. The engine 10 includes an augmentor pilot

16 that is used to ignite an air/fuel mixture. The augmentor pilot 16 may be part of any system of the engine 10 in which combustion is desired.

The augmentor pilot 16 includes an injector 18 that provides fuel to a combustion chamber 20. The injector 18 includes a support 19 locating the injector 18 in a desired position relative to an inlet 26 of the combustion chamber 20. The combustion chamber 20 includes a wall 24 having an igniter 22 that ignites the air/fuel mixture.

A swirler 28 is located upstream from the combustion chamber 20 and introduces air to the fuel provided by the injector 18. The swirler 28 includes vanes 30 that introduces a desired flow conducive to homogeneously mixing and atomizing the air/fuel mixture for improved ignition and combustion. The swirler 28 includes a high pressure side 12 upstream from the swirler 28 and associated with a source of the air. The swirler 28 has a low pressure side 14 opposite the high pressure side 12, which is associated with the pressure within the combustion chamber 20. When the pressure differential between the high and low pressure sides 12, 14 becomes too great, it becomes difficult to ignite the mixture. Typically, the velocity of the mixture in such a condition is higher than desired making it difficult to light the air/fuel mixture on-the-fly.

In one example, a hood 32 is arranged about the swirler 28 at least partially enclosing it. The hood 32 operates to decrease the differential pressure across the swirler 28 so that it is easier to light the mixture on-the-fly in what would otherwise be adverse operating conditions for the engine 10. In one example, the hood 32 reduces the pressure drop across the swirler 28 by approximately fifty percent.

In one example, the hood 32 includes first and second spaced apart walls 38, 40 interconnected by an outer perimeter wall 36. The walls 36, 38, 40 provide an interior cavity. The swirler 28, when the hood 32 is installed over the swirler 28, provides an inner perimeter 31 through which air from the high pressure side 12 enters the inlet 26.

Figure 2:
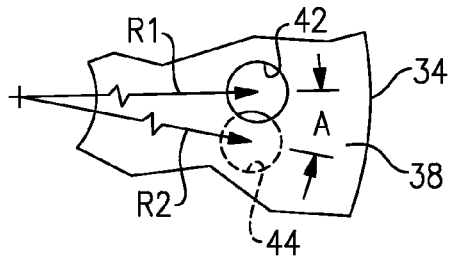
FIG. 2 is a top elevational view of a portion of a hood shown in FIG. 1.

In one example, the first and second spaced apart walls 38, 40 each include an array of first and second apertures 42, 44 that create a tortuous path from the high pressure side 12 to the low pressure side 14. Referring to FIG. 2, it may be desirable to offset the first and second apertures 42, 44 relative to one another so that the air entering through the apertures 42, 44 impinges on the opposite wall through which it enters thereby decreasing its velocity. As a result, the velocity of the air flow entering the inlet 26 is decreased and the differential pressure is decreased. In the example shown in FIGS. 1 and 2, the first and second apertures 42, 44 respectively include first and second radial distances R1, R2 that are generally equal to one another. An angular offset A is provided between the first and second apertures 42, 44 to ensure impingement of air flow on the opposite wall. Alternatively and/or in addition to the angular offset described above, the radial distances R1, R2 can be different from one another to create an offset.

Figure 3:
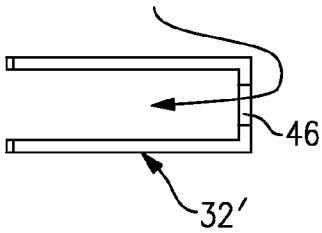
FIG. 3 is a cross-sectional view of another example hood.

It should be understood that although an array of apertures is shown in each of the first and second spaced apart walls 38, 40, apertures may only present on one of the walls 38, 40, if desired. Alternatively and/or in addition to apertures in one or more of the first and second spaced apart walls 38, 40, an array of apertures 46 may be provided in the outer perimeter wall 36, as shown in FIG. 3. The hood 32' in FIG. 3 forces the air, which generally flows in a direction toward the first wall 38, to enter at the outer perimeter wall 36.

Although a preferred embodiment has been disclosed, a worker of ordinary skill in this art would recognize that certain modifications would come within the scope of the claims.

For that reason, the following claims should be studied to determine their true scope and content.

What is claimed is:

1. A gas turbine engine pilot assembly comprising:

a swirler having high and low pressure sides; and a hood upstream from and at least partially enclosing the swirler on the high pressure side, the hood including an aperture creating a tortuous path from the high pressure side to the low pressure side through the swirler, wherein the hood includes first and second spaced apart walls interconnected by an outer perimeter wall, at least one of the walls including an array of the apertures in communication with an interior cavity provided by the walls.

2. The assembly according to claim 1, wherein the swirler includes vanes for inducing a desired flow of air from the high pressure side to the low pressure side.

3. The assembly according to claim 1, comprising a fuel injector for introducing fuel to the low pressure side downstream from the swirler.

4. The assembly according to claim 3, comprising a combustion chamber arranged downstream from the fuel injector and swirler, the swirler including vanes inducing a desired air/fuel mixture flow into the combustion chamber.

5. The assembly according to claim 4, wherein the combustion chamber includes an igniter for igniting the mixture.

6. The assembly according to claim 1, wherein the hood is generally annular in shape, the hood secured over the swirler, the swirler providing an inner perimeter to the cavity.

7. A gas turbine engine pilot assembly comprising:

a swirler having high and low pressure sides;

a hood at least partially enclosing the swirler on the high pressure side, the hood including an aperture creating a tortuous path from the high pressure side to the low pressure side through the swirler;

wherein the hood includes first and second spaced apart walls interconnected by an outer perimeter wall, at least one of the walls including an array of the apertures in communication with an interior cavity provided by the walls;

wherein the hood is generally annular in shape, the hood secured over the swirler, the swirler providing an inner perimeter to the cavity; and wherein the first and second spaced apart walls respectively include an array of first and second apertures offset from one another.

8. A hood assembly for a gas turbine engine combustion system comprising:

first and second spaced apart walls interconnected by an outer perimeter wall, the walls forming an interior cavity, and at least one of the walls including an array of apertures in communication with the cavity; and a swirler providing an inner perimeter at the cavity.

9. The assembly according to claim 8, wherein the first and second spaced apart walls respectively include an array of first and second apertures.

10. The assembly according to claim 9, wherein the first and second apertures are offset from one another for causing air entering the apertures to impinge on the opposite wall.

11. The assembly according to claim 8, wherein the outer perimeter wall includes an array of apertures.

12. The assembly according to claim 8, wherein the swirler includes vanes for inducing a desired air flow.

* * * * *